US005628474A

United States Patent [19]

Krueger et al.

[11] Patent Number: 5,628,474

[45] Date of Patent: May 13, 1997

[54] SPRING BIASED AUTOMATIC MULTI ROLL PAPER DISPENSER

[75] Inventors: Donald G. Krueger, Green Bay; Kenneth H. LaCount, Pulaski, both of Wis.

[73] Assignee: Alwin Manufacturing Co., Green Bay, Wis.

[21] Appl. No.: 510,142

[22] Filed: Aug. 2, 1995

[51] Int. Cl.[6] ..... B65H 19/00

[52] U.S. Cl. ..... 242/559.4; 242/560; 242/597.5

[58] Field of Search ..... 242/559, 559.3, 242/559.4, 561, 563.2, 560, 597.2, 597.5

[56] References Cited

U.S. PATENT DOCUMENTS

| | | | |
|---|---|---|---|
| 2,767,930 | 10/1956 | McCants | 242/561 X |
| 3,228,618 | 1/1966 | Bracken | 242/597.5 |
| 3,398,908 | 8/1968 | Thompson | 242/597.5 |
| 3,416,744 | 12/1968 | Mott, Sr. et al. | 242/561 X |
| 3,482,796 | 12/1969 | Tucker | 242/597.5 |
| 3,598,331 | 8/1971 | Okamura | 242/561 X |

*Primary Examiner*—Daniel P. Stodola
*Assistant Examiner*—William A. Rivera
*Attorney, Agent, or Firm*—Ryan, Maki, Mann & Hohenfeldt

[57] ABSTRACT

A two roll paper dispenser has roll-supporting mandrels mounted on slide blocks in a cantilevered position. The mandrels are automatically movable from a position wherein the first mandrel is located at a juncture of a first path and a second path and the second mandrel is located above the first mandrel in the first path and wherein the first mandrel can be moved from the juncture along carried thereon to open the juncture when sufficient paper is consumed from its roll. A spring engages the first mandrel slide block biasing the mandrel for movement away from the juncture, and the second mandrel slide block is biased for movement along the second path toward the juncture. The mandrels each have a proximal end attached to one of the mandrel slide blocks and a distal free end for insertion thereon of a roll of paper.

7 Claims, 3 Drawing Sheets

SPRING BIASED AUTOMATIC MULTI ROLL PAPER DISPENSER

FIELD OF THE INVENTION

The present invention relates to dispensers for toilet paper rolls in which a spare roll is stored in an inoperative position so that when one roll is exhausted, the extra roll can readily be moved into a dispensing position.

BACKGROUND OF THE INVENTION

Two roll paper dispensers have been widely used particularly in commercial and industrial buildings, public institutions or the like. An example of such a dispenser is shown in commonly owned U.S. Pat. No. 4,422,585 (Schultz et al.), issued Dec. 27, 1983. The present invention relates to improvements in several respects to the type of toilet paper dispensers shown in said patent.

SUMMARY OF THE INVENTION

The present invention provides an improved two roll toilet paper dispenser having a simple construction. In accordance with one aspect of the invention an improved configuration for the toilet paper roll holding and dispensing mandrels is provided. In accordance with a related aspect of the invention, the mandrels are provided with projections or enlargements on opposite ends thereof to restrict the end to end movement thereon of a roll of paper.

In accordance with a further related aspect of the invention, the shape of the mandrels is configured so that the successive rolls of paper can be easily placed thereon by sliding and dropping between two end projections and also readily removed therefrom by reversing this procedure.

In accordance with a still further aspect of the invention, one or both mandrels are provided with spring biasing means to ensure movement of the mandrel holding mechanism so that when one roll of paper is exhausted, the roll is moved by its mandrel to a position out of the way of the second roll and the second roll is preferably also moved by the force of gravity into the dispensing position.

Briefly, the invention provides a dispenser for paper wound into rolls including walls defining an enclosure for confining first and second rolls of paper and defining an access opening opposite a rear wall to enable removal of sheets from the rolls. First and second mandrels are mounted on slide blocks for supporting the mandrels in a cantilevered position. Guide paths are formed on a wall of the housing with the guide paths having first and second portions, the second portion being transverse to the first portion and the slide blocks being mounted for movement in the guide paths and supporting the mandrels in a cantilevered position. The mandrels are movable from a first position wherein the first mandrel slide block is located at a juncture of the first path portion and the second path portion and the second mandrel slide block is located above the first mandrel slide block in the first path portion when the mandrels are in the first position and wherein the first mandrel slide block can be moved from the juncture along the second path portion when sufficient paper is consumed from the roll carried thereon to open the juncture so that the slide block of the second mandrel can be moved into the juncture of the first and second path portions to expose the second roll to the access opening.

A spring engages the first mandrel slide block biasing the mandrel for movement along the first path away from the juncture. Preferably, the second mandrel slide block is moved by gravity along the second path toward the juncture. If desired, a spring can be provided for biasing the second mandrel for such movement. In accordance with a preferred embodiment the housing is provided with a metering block or projection on its rear wall which serves multiple functions. The metering block is positioned to engage a roll of paper on the first mandrel whereby movement of the second mandrel to the juncture 41 is prevented until the roll of paper on the first mandrel is exhausted. The projection preferably has a convex or similar friction-reducing surface for engaging the roll of paper on the first mandrel. The projection, or metering block also serves to limit the diameter of a roll allowed to be placed on the mandrel thus affording proprietary dimensioning of the dispenser by individual paper manufacturers. Also, at least one, and preferably both, of the first and second mandrels is provided with upper and lower surfaces, the mandrels each having a proximal end attached to one of the mandrel slide blocks and a distal free end for insertion thereon of a roll of paper. The distal end is tapered on its lower surface to a reduced diameter and is provided on its upper surface with an upwardly extending projection.

Further objects and advantages of the invention will become apparent from the following detailed description, claims and accompanying drawings.

DETAILED DESCRIPTION OF THE PREFERRED EMBODIMENT

Figure 1:
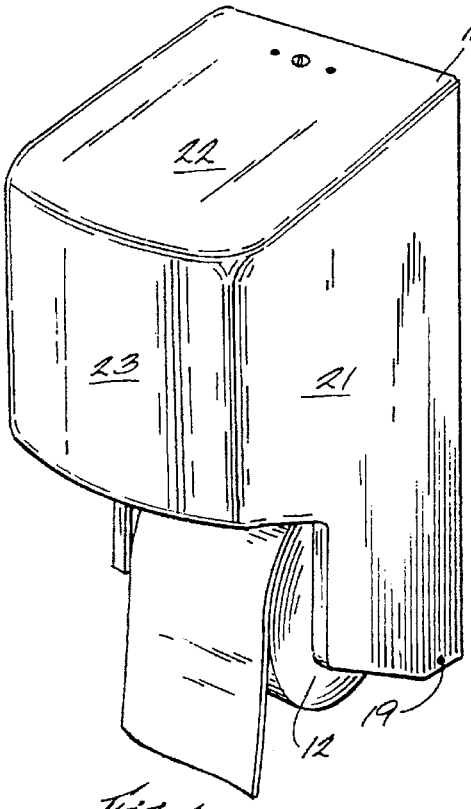
FIG. 1 is a perspective view of a dispenser according to the invention.
Figure 2:
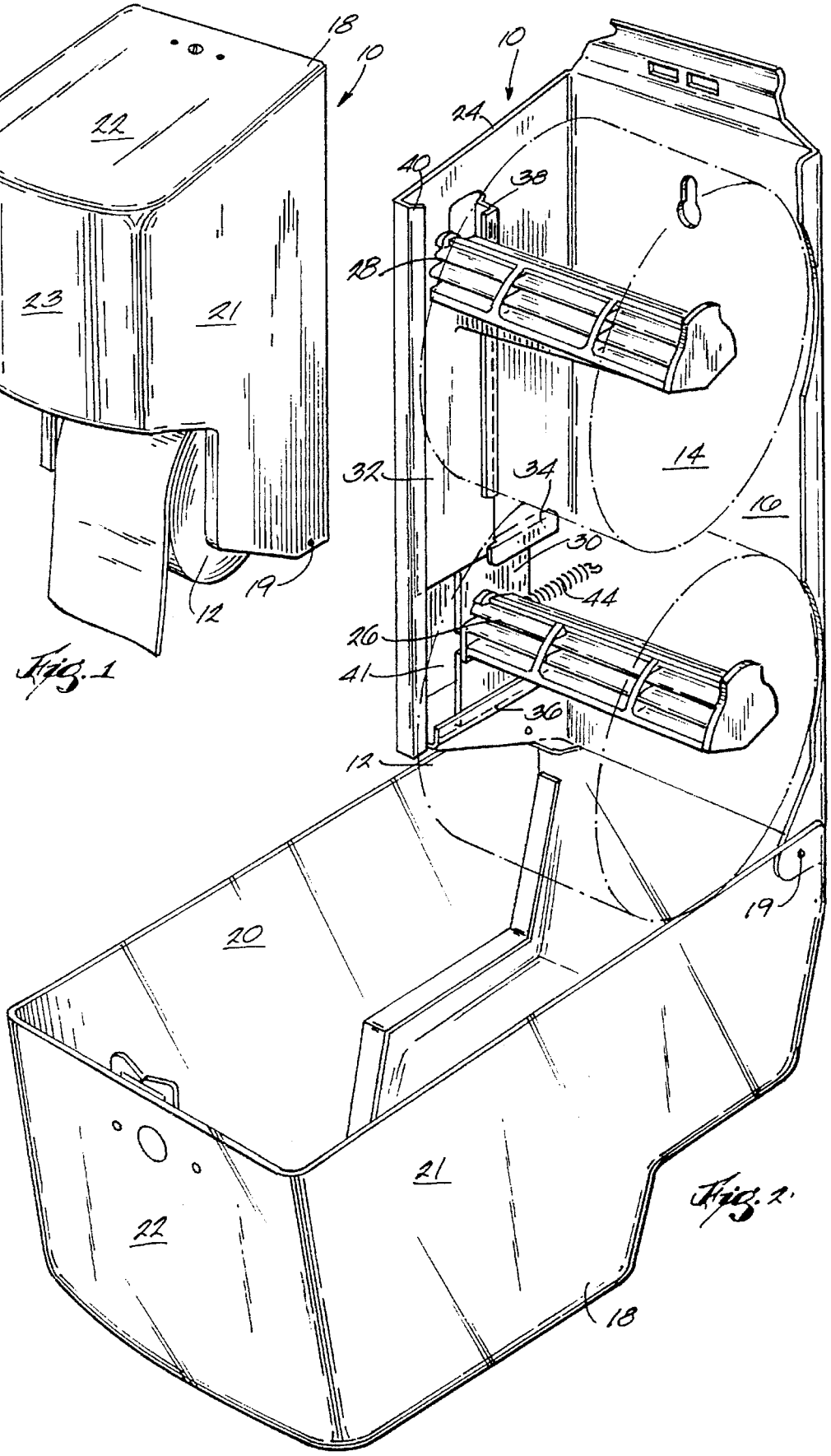
FIG. 2 is a perspective view of the dispenser of FIG. 1 shown with the cover pivoted to the open position and showing rolls of paper by phantom lines for clarity of interior detail.
Figure 4:
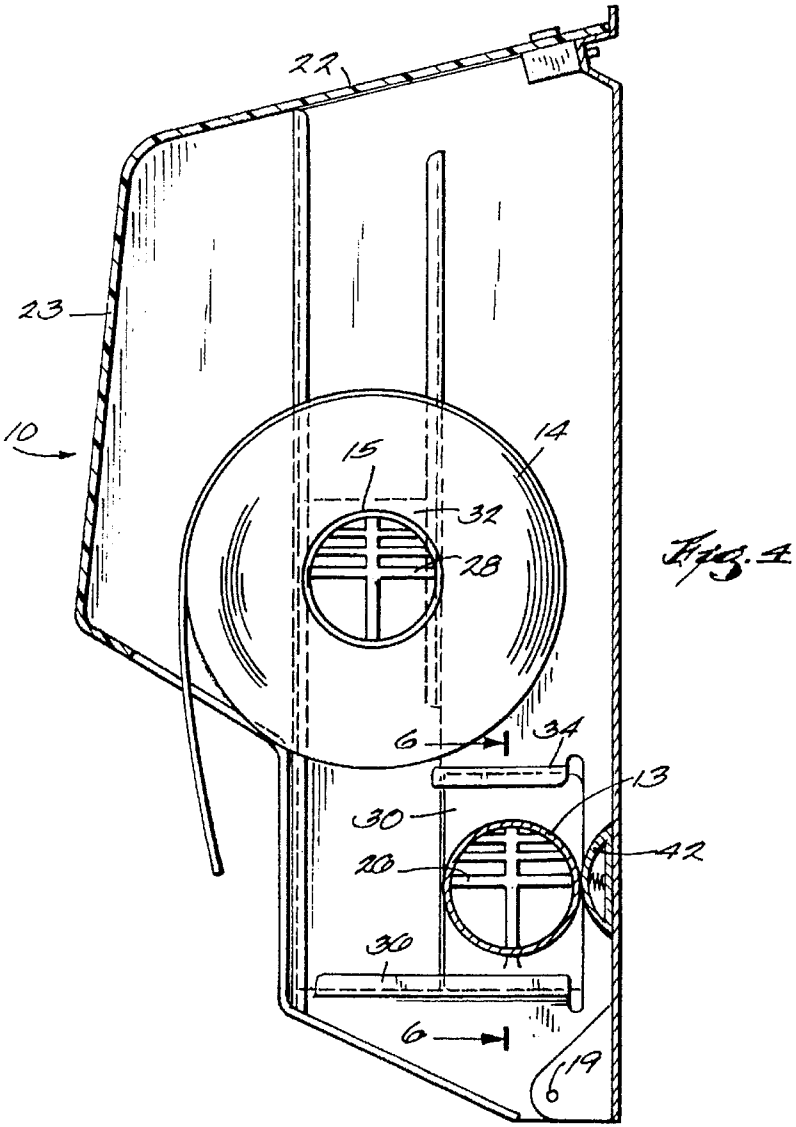
FIG. 4 is a central sectional side view as shown in FIG. 3 but with one of the rolls empty and the second roll positioned in the dispensing v position.
Figure 3:
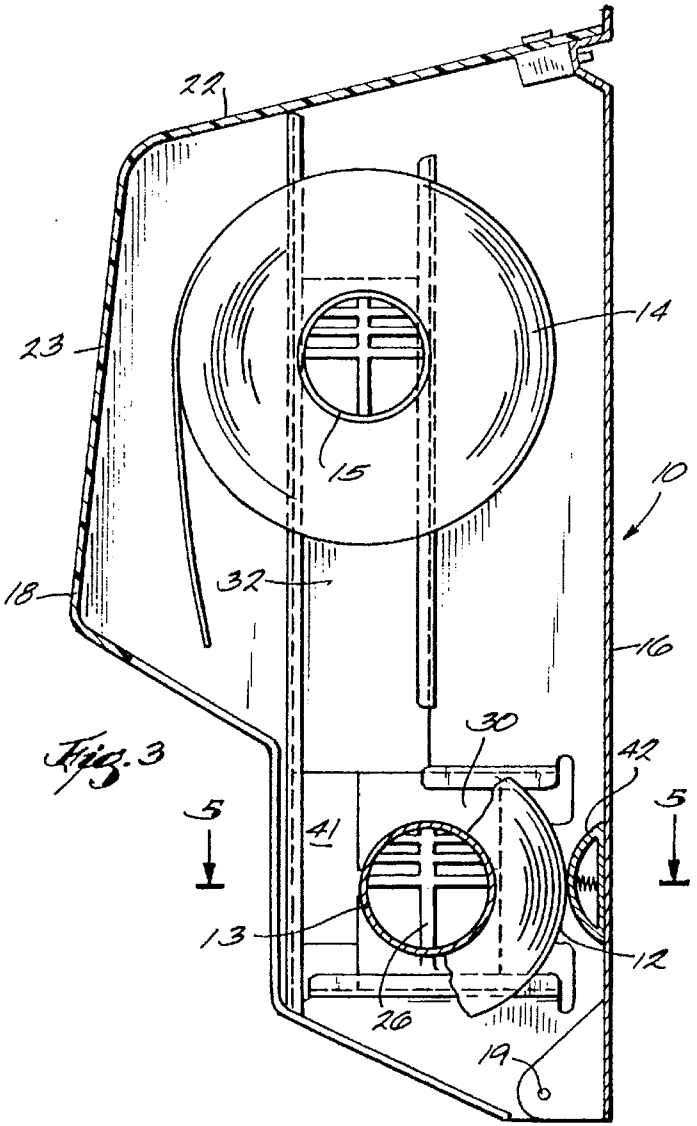
FIG. 3 is a central sectional side view of the dispenser of FIG. 1.

Referring more particularly to the drawings, there is a dispenser 10 for rolled paper in accordance with the invention. In the illustrated embodiment the dispenser is intended for dispensing sheets of toilet paper from rolls 12 and 14. Rolls 12 and 14 are wound on conventional cardboard cores 13 and 15, respectively.

Dispenser 10 is formed from a housing of rigid material such as metal, molded plastic or composite materials and includes a rear wall 16 to the lower end of which is pivotally connected a cover 18 by means of hinge pins 19. Cover 18 includes side walls 20 and 21, a top 22 and a front panel 23, the lower end of which is open to provide access to the paper rolls 12 and 14.

An interior side panel 24, which may be integral with rear panel 16 provides a support for a pair of mandrels 26 and 28 which in turn support rolls of paper 12 and 14, respectively, for dispensing. Mandrels 26 and 28 are mounted on slide blocks 30 and 32 which may be formed integrally with the proximal base of the respective mandrels 26 and 28. Slide blocks 30 and 32 are slidably mounted for travel within a pair of intersecting paths formed by opposed clips 34, 36, 38 and 40. Clips 34 and 36, which may be formed by in turned flanges, as shown, form a first path for sliding travel of block 30 horizontally near the bottom of side panel 24 while clips 38 and 40 form a vertical travel path for sliding therein of mandrel support block 32. As seen, the travel paths for the slide blocks 30 and 32 intersect at a juncture 41 at the lower forward corner of the dispenser.

Figure 5:
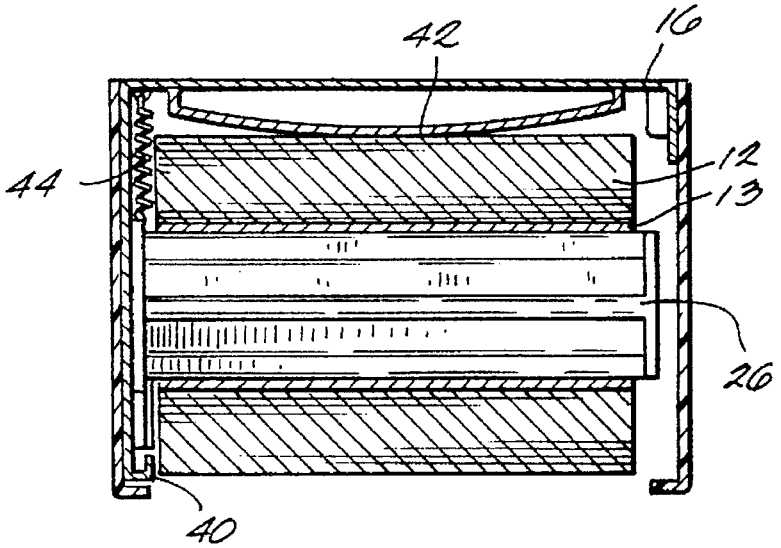
FIG. 5 is a sectional view taken along line 5—5 of FIG. 4.
Figure 6:
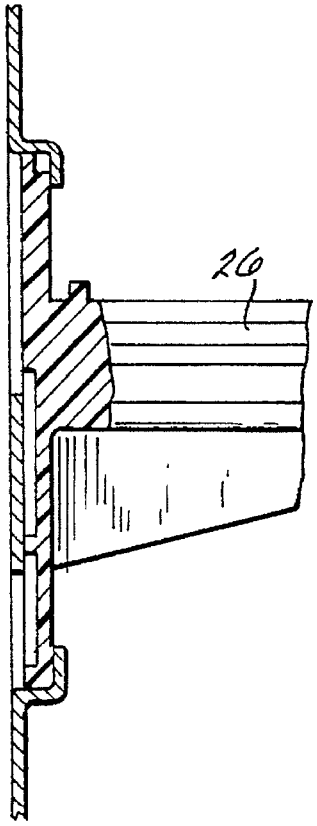
FIG. 6 is a fractional sectional view taken along line 6—6 of FIG. 4.

Attached to the rear wall 16 is a metering block 42 which engages the rear surface of paper roll 12 and thus limits the size of a roll 12 that can be inserted in the dispenser. Metering block 42 can vary in size and shape to prevent the use of the dispenser for product rolls not conforming to predetermined intended sizes for which the dispenser was designed. Block 42 also serves to prevent roll 12 and its associated mandrel 26 from sliding rearwardly within dispenser cabinet 10 enough to permit dropping of mandrel 28 and roll 14 into juncture 41 until roll 12 has been depleted. The roll-engaging surface of metering block 42 is preferably convexly shaped, as shown, but other shapes can be substituted. As seen, block 42 is preferably convex when viewed from the top as shown in FIG. 5. A biasing means such as coil spring 44 provides a continuous force of roll 12 against block 42. This biasing force assures the movement of block 30 rearwardly along or in flanges 34 and 36, so that mandrel 26 and slide block 30 are out of the way thereby allowing slide block 32 to move downwardly when roll 12 is depleted so as to expose roll 14 for dispensing.

In addition to the foregoing specified embodiments, it will be apparent to those skilled in the art that further modifications and adaptations can be made. The foregoing specific embodiments therefore should be viewed as being illustrative and all modifications falling within the meaning and equivalency range of the appended claims are intended to be embraced therein.

I claim:

1. A dispenser for paper wound into rolls comprising walls defining an enclosure for confining first and second rolls of paper and defining an access opening opposite a rear wall to enable removal of sheets from said rolls, first and second mandrels, slide blocks for supporting said mandrels in a cantilevered position, a guide path formed on a wall of said enclosure, said guide path having first and second portions, with said second portion being transverse to said first portion and said slide blocks being mounted for movement in said guide path from a first position wherein said first mandrel slide block is located at a juncture of said first path portion and said second path portion and said second mandrel slide block is located above said first mandrel slide block in said first path portion and wherein said first mandrel slide block is moved from said juncture along said second path portion when sufficient paper is consumed from the roll carried thereon to open the juncture so that said slide block of said second mandrel is moved into said juncture to expose said second roll to said access opening, the improvement which comprises a spring engaging said first mandrel slide block wherein, as the diameter of the first roll on said first mandrel decreases, said spring pulls said first mandrel slide block along said first path away from said juncture.

2. A dispenser according to claim 1 wherein said second mandrel slide block moves along said second path toward said juncture by the force of gravity.

3. A dispenser according to claim 1 wherein said enclosure is provided with a projection on its rear wall, said projection being positioned to engage a roll of paper on said first mandrel whereby movement of said second mandrel to said juncture is prevented until said roll of paper on said first mandrel is exhausted.

4. A dispenser according to claim 3 wherein said projection has a convex surface for engaging said roll of paper on said first mandrel.

5. A dispenser according to claim 1 wherein at least one of said first and second mandrels is provided upper and lower surfaces, said mandrels each having a proximal end attached to one of said mandrel slide blocks and a distal free end for insertion thereon of a roll of paper, said distal end being tapered on its lower surface to a reduced diameter and being provided on its upper surface with an upwardly extending projection.

6. A dispenser according to claim 1 wherein said slide blocks are integrally formed with said mandrels.

7. A dispenser for paper wound into rolls comprising walls defining an enclosure for confining a plurality of rolls of paper and defining an access opening opposite a rear wall to enable removal of sheets from said rolls, a first and second mandrel mounted on slide blocks for supporting said mandrels in a cantilevered position, guide paths formed on a wall of said housing, said guide paths being adapted to successively convey said mandrels into proximity of said access opening for dispensing of paper therefrom, said slide blocks being mounted for movement in said guide paths, wherein said mandrels each have a proximal end attached to one of said mandrel slide blocks and a distal free end for insertion thereon of a roll of paper, said distal end being provided on its upper surface with an upwardly extending projection a spring engaging a first one of said mandrel slide blocks biasing said first mandrel slide block, wherein, as the diameter of said roll of paper decreases, said spring pulls said first mandrel slide block along one of said guide paths away from said access opening, and wherein a second one of said mandrel slide blocks moves toward said access opening by the force of gravity when said first mandrel slide block is moved away from said access opening a sufficient distance along said one guide path to expose said roll on said second mandrel to said access opening.

* * * * *